US009572476B2

(12) United States Patent
Cetinkaya et al.

(10) Patent No.: US 9,572,476 B2
(45) Date of Patent: Feb. 21, 2017

(54) DISHWASHER COMPRISING A SINGLE BUTTON

(75) Inventors: Ebru Gokhan Cetinkaya, Istanbul (TR); Tolga Ali Cirak, Istanbul (TR); Ahmet Ferit Cosan, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 800 days.

(21) Appl. No.: 13/518,873

(22) PCT Filed: Dec. 15, 2010 (Under 37 CFR 1.47)

(86) PCT No.: PCT/EP2010/069753

§ 371 (c)(1), (2), (4) Date: Feb. 24, 2014

(87) PCT Pub. No.: WO2011/076630

PCT Pub. Date: Jun. 30, 2011

(65) Prior Publication Data

US 2014/0216509 A1 Aug. 7, 2014

(30) Foreign Application Priority Data

Dec. 23, 2009 (TR) ..... a 2009 09709

(51) Int. Cl.
*A47L 15/42* (2006.01)
*A47L 15/46* (2006.01)

(52) U.S. Cl.
CPC ..... *A47L 15/4293* (2013.01); *A47L 15/4259* (2013.01); *A47L 15/46* (2013.01); *A47L 15/4257* (2013.01); *A47L 2401/26* (2013.01); *A47L 2501/30* (2013.01); *A47L 2501/36* (2013.01)

(58) Field of Classification Search
CPC ..... A47L 15/4257; A47L 15/4259; A47L 15/4293; A47L 15/46; A47L 2401/26; A47L 2501/30; A47L 2501/36
USPC .. 134/56 D, 57 D, 57 DL, 58 D, 58 DL, 113
See application file for complete search history.

(56) References Cited

FOREIGN PATENT DOCUMENTS

WO WO 2009132953 A1 * 11/2009 ..... A47L 15/4293

* cited by examiner

*Primary Examiner* — Michael Barr
*Assistant Examiner* — Levon J Shahinian
(74) *Attorney, Agent, or Firm* — Kilpatrick Townsend & Stockton LLP

(57) ABSTRACT

The present invention relates to a dishwasher (1) comprising a door (2), a control panel (3) disposed at the upper side of the door (2), a latch (4) disposed on the door (2) and providing the door (2) to be releasably locked, an on/off switch (5) disposed on the door (2) that provides the dishwasher (1) to be energized or to turn off the supplied energy, a control card (6) providing to perform an automatic washing program (P) the parameters of which are determined according to data such as dirt level of the dishes and temperature of the wash water, a single start button (7) providing the automatic washing program (P) to be started by the user pressing thereon and a display (8) that provides the user to monitor the data relating to the washing process and wherein changes can be made in the washing program or the display (8) language (L) by means of a single start button (7).

16 Claims, 1 Drawing Sheet

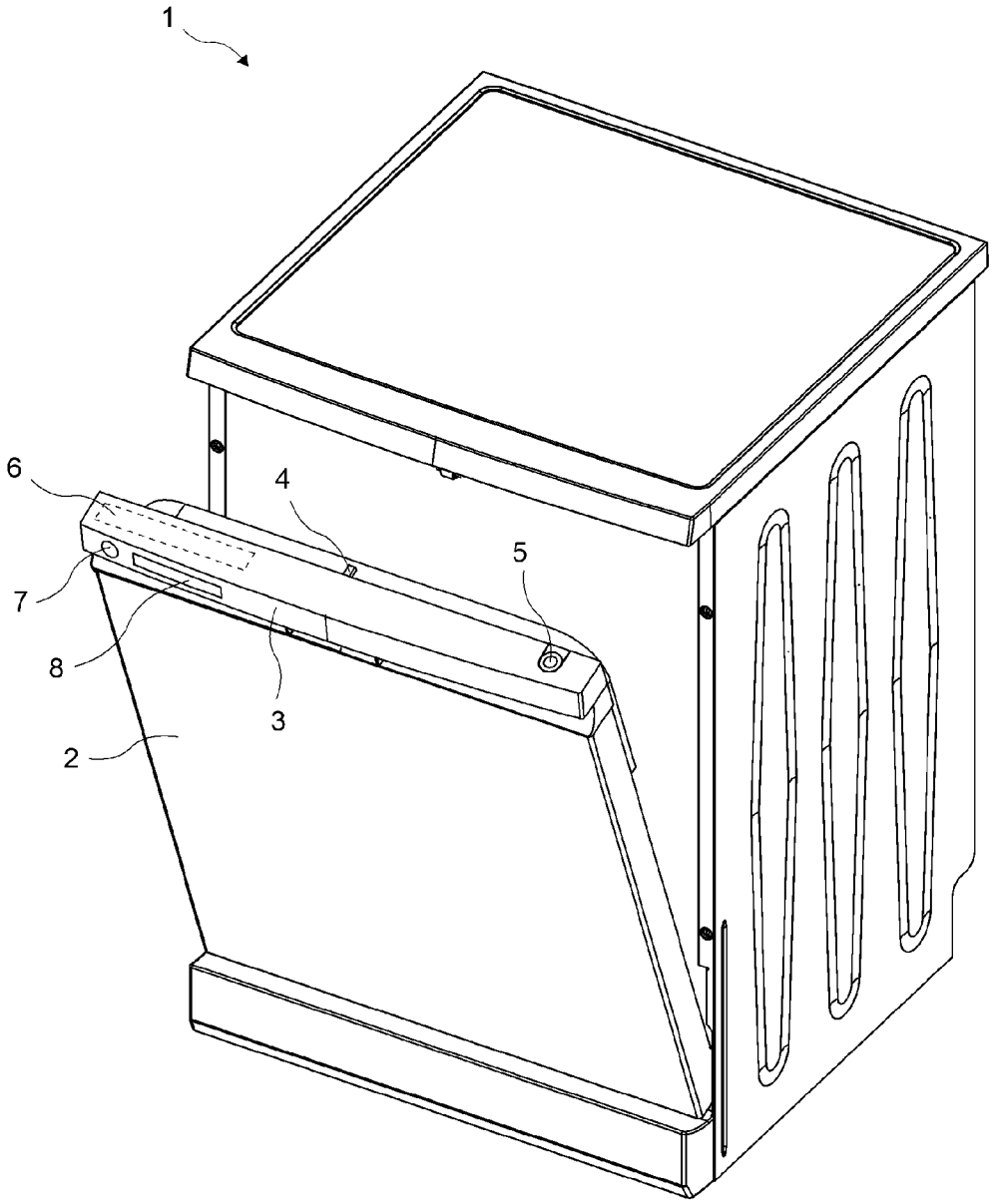
1
6
4
5
7
8
3
2

DISHWASHER COMPRISING A SINGLE BUTTON

The present invention relates to a dishwasher comprising a single touch-button that provides the washing program to be started and the user to make program changes.

In dishwashers comprising single buttons which the user can use to start the washing process, separate buttons are not provided for different washing programs or functions, the washing program is started with a start button disposed on the door after the machine is energized and an automatic washing program is executed that performs the washing process depending on the dirt amount of the dishes to be washed. In this type of machines, factors such as the amount of dishes, the dirt level of the dishes, temperature and hardness of the washing water are detected by various sensors and the washing program is performed by automatic selection without requiring any intervention of the user. The start button, besides its function of starting the washing program, also allows entering into the setting menu, thus the errors can be identified, function tests are realized, a reference washing program loaded to the control card is performed for moderately dirty dishes, regardless of the amount of dirt and different than the automatic washing program or the language selection of the display is made depending on the country wherein the dishwasher is used by means of the settings menu reached from the start button. In known embodiments, reaching the setting menu by means of the start button is a complicated process in terms of the user and the setting menu is reached by the service personnel through the use of additional apparatuses or pressing the start button according to a prearranged algorithm. In the state of the art, since the dishwashers are designed so that the user cannot easily reach the setting menu in terms of safety reasons, the user cannot easily activate a different washing program than the automatic washing program, for example the recorded reference program for normal dirty dishes and cannot change the display language.

In the state of the art European Patent No EP0857454, a built-in washing appliance is explained wherein the washing programs can be selected by a rotary knob disposed on the door.

The aim of the present invention is the realization of a dishwasher wherein the user can make changes in the washing program by means of the single touch-button that starts the washing program.

The dishwasher realized in order to attain the aim of the present invention, explicated in the first claim and the respective claims thereof, comprises a control card that provides implementation of an automatic washing program with parameters determined according to data such as dirt level of the dishes and temperature of the wash water, a single start button providing the automatic washing program present in the memory of the control card to be started upon being pressed by the user and the control card provides the start button to perform different functions when the dishwasher door is in the closed or open positions.

The start button starts the automatic washing program when pressed once by the user when the door is in the closed position, and allows reaching the setting menu options wherein setting and test operations are performed when pressed once by the user when the door is in the open position.

In an embodiment of the present invention, in the setting menu reached by means of the start button, the reference program option is present that is used for the purpose of washing test regardless of the dirt amount and which can be preferred in some situations by the user in the washing process due to low energy consumption and the control card provides reaching the reference program option directly by the user pressing the start button once for a certain time period when the door is in the open position. Upon reaching the reference program, "Ref. Program On (ON)" and "Ref. Program Off (OFF)" options are displayed on the display and the user saves the desired option by means of the start button thus providing the reference program or the recorded automatic washing program to be executed in the washing process.

In an embodiment of the present invention, the option for changing the display language is present in the setting menu reached with the start button and the control card provides reaching the option of changing the display language directly when the start button is pressed by the user once for a certain time period while the door is in the open position. In this embodiment, after reaching the language changing option, by pressing the start button successively various languages are provided to appear on the display as "Türkçe", "English", "Deutsch" . . . and when the desired language is seen on the display it is saved by again pressing the start button.

In another embodiment of the present invention, both options of changing the display language and the reference program are present in the setting menu and when the start button is pressed once for a certain time period by the user while the door is in the open position, the control card provides firstly the display language changing option to be reached and after the language changing process is performed or without performing any language change, the display language changing option to be left when the start button is pressed once for a short time and simultaneously the reference program option to be entered.

In the dishwasher of the present invention, the user can easily reach changing the display language or reference program options in the setting menu, wherein setting and test processes are performed by means of the start button while the door is open.

The dishwasher realized in order to attain the aim of the present invention is illustrated in the attached figures, where:

FIG. 1—is the perspective view of a dishwasher.

The elements illustrated in the figures are numbered as follows:

1—Dishwasher
2—Door
3—Control panel
4—Latch
5—On/off switch
6—Control card
7—Start button
8—Display The dishwasher (1) comprises a body, a door (2) providing the user to access into the body, a control panel (3) disposed at the upper side of the door (2), a latch (4) disposed on the door (2) and which provides the door (2) to be locked easily releasable manner, an on/off switch (5) disposed on the door (2) that provides the dishwasher (1) to be energized or to turn off the supplied energy, a control card (6) providing to perform an automatic washing program (P) the parameters of which are determined according to data such as dirtiness level of the dishes and temperature of the wash water, a single start button (7) disposed on the front surface of the control panel (3), providing the automatic washing program (P) to be started when pressed thereon by the user and furthermore to perform the test and setting processes by entering into the setting menu (S) present in the memory of the control card (6) by the service personnel through means of additional apparatuses or algorithms when the need for changing any settings is required and a display (8) disposed on the front face of the control panel (3) and which provides the user to monitor the data relating to the washing process.

The dishwasher (1) of the present invention comprises the control card (6)

- that starts the automatic washing program (P) when the start button (7) is pressed once by the user and when the door (2) is detected to be closed by means of the signal delivered by the latch (4) when the door (2) is in the closed position and
- that provides the setting menu (S) options to be reached when the start button (7) is pressed once by the user by changing the function of the start button (7) when the door (2) is detected to be open by means of the signal delivered by the latch (4) when the door (2) is in the open position, and the settings in the setting menu (S) to be changed when the start button (7) is pressed again by the user.

In an embodiment of the present invention, the control card (6) provides reaching the options in the setting menu (S) when the start button (7) is pressed by the user for a certain time period (T1) when the door (2) is in the open position.

In the dishwasher (1) of the present invention, execution of the washing program and entering into the setting menu (S) operations are performed by the single start button (7) and the automatic washing program (P) is started by the control card (6) when the start button (7) is pressed once by the user while the door (2) is closed. While the door (2) is in the open position, the function of the start button (7) is changed by the control card (6), the options in the setting menu (S) are reached easily when the start button (7) is pressed once for a certain time period (T1) and the desired changes in the settings are made by again pressing the start button (7).

In another embodiment of the present invention, the reference program option is present in the setting menu (S) that is used for the purpose of the washing test regardless of the dirt amount and the control card (6) provides the reference program option to be reached directly when the start button (7) is pressed by the user for a certain time period (T1) while the door (2) is in the open position, and when the start button (7) is pressed again, provides the reference program to be saved and the reference program to be executed in the washing process instead of the automatic washing program (P).

In some situations, the user may prefer to use the reference program, regardless of the dirt amount of the dishes that consumes less energy by completing the washing process in a shorter time period than the automatic washing program (P). In this embodiment, while the door (2) is in the open position, the user can directly reach the reference program easily which is one of the options in the setting menu (S) by pressing the start button (7) for a certain time period (T1) and saves the "Ref. Program ON" option by the start button (7) and provides execution of the reference program in the washing process. In order to cancel the reference program, the user again presses the start button (7) while the door (2) is in the open position to save the "Ref. Program OFF" option and the automatic washing program (P) is executed in the washing process by cancelling the reference program.

In this embodiment, in the dishwasher (1) the below given steps are followed for execution of the reference program instead of the automatic washing program (P):

- energizing the dishwasher (1) by pressing the on/off switch (5) while the door (2) is in the open position,
- entering into the setting menu (S) by pressing the start button (7),
- displaying the "Settings" inscription on the display (8),
- continuing to press the start button (7) for a certain time period (T1), e.g. for 10 seconds and in the meantime giving time information to the user with the countdown on the display (8),
- displaying "Ref. Program OFF" inscription on the display (8) at the end of the countdown,
- changing to "Ref. Program ON" mode by pressing the start button (7),
- saving the "Ref. Program ON" option by pressing the start button (7) for a certain time period (T2), e.g. for 5 seconds,
- leaving the reference program option by turning off and on the on/off switch (5),
- pressing the start button (7) after closing the door (2) and executing the reference program.

In an embodiment of the present invention, the option for changing the display (8) language (L) is present in the setting menu (S) and the control card (6) provides the option of changing the display (8) language (L) to be reached directly when the user presses the start button (7) once for a certain time period (T1) while the door (2) is in the open position and various languages to be displayed successively on the display (8) as "Türkçe", "English", "Deutsch" . . . by again pressing the start button (7) and upon reaching the desired language, provides the desired language to be saved by pressing the start button (7).

In the dishwasher (1) in this embodiment, the below given steps are followed for changing the display (8) language:

- energizing the dishwasher (1) by pressing the on/off switch (5) while the door (2) is in the open position,
- entering into the setting menu (S) by pressing the start button (7),
- displaying the "Settings" inscription on the display (8),
- continuing to press the start button (7) for a certain time period (T1), e.g. for 10 seconds and in the meantime giving time information to the user with the countdown on the display (8),
- displaying "Language" inscription on the display (8) at the end of the countdown,
- entering into the language (L) options by pressing the start button (7) for a certain time period (T3), e.g. for 5 seconds,
- displaying language (L) options on the display (8) respectively like "Türkçe", "English", "Deutsch" . . . by pressing the start button (7) successively,
- selecting the desired language (L) and saving by pressing the start button (7) for a certain time period (T4), e.g. for 5 seconds,
- leaving the display (8) language (L) changing option by turning off and on the on/off switch (5).

In another embodiment of the present invention, both options of changing the display (8) language (L) and the reference program are present in the setting menu (S) and when the start button (7) is pressed once for a certain time period (T1) by the user while the door (2) is in the open position, the control card (6) provides firstly the display (8) language (L) changing option to be reached and after changing the display (8) language (L) or without making a change, the display (8) language (L) changing option to be left when the start button (7) is pressed again and simultaneously the reference program option to be entered.

In this embodiment, when the user presses the start button (7) for a certain time period (T1) she or he directly reaches the display (8) language (L) changing option and when the start button (7) is pressed again for a short time after performing the language changing process or without performing the language changing process, she or he leaves the display (8) language (L) changing option and reaches the reference program option.

In the dishwasher (1) of the present invention, the user easily reaches changing the display (8) language (L) and the reference program options desired to be changed in the setting menu (S) by means of the start button (7) while the door (2) is open and the processes of changing the washing program or the display (8) language (L) can be easily performed by the user particularly in situations wherein access to the service means are limited.

It is to be understood that the present invention is not limited by the embodiments disclosed above and a person skilled in the art can easily introduce different embodiments. These should be considered within the scope of the protection postulated by the claims of the present invention.

The invention claimed is:

1. A dishwasher (1) comprising a door (2), a control panel (3) disposed at an upper side of the door (2), a latch (4) disposed on the door (2) and providing the door (2) to be locked, an on/off switch (5) disposed on the door (2) that provides the dishwasher (1) to be energized or to be turned, a control card (6) providing an automatic washing program (P) parameters determined according to data such as dishes dirtiness level and wash water temperature, a single start button (7) and a display (8) that allows monitoring the data relating to a washing process, wherein the control card (6) is configured to:

detect that the door (2) is closed by means of a signal delivered from the latch (4) and start the automatic washing program (P) stored in a memory of the control card when the start button (7) is pressed once, and detect that the door (2) is open by means of the signal delivered by the latch (4) and provide options in a setting menu (S) to be reached when the start button (7) is pressed once providing settings from the setting menu (S) to be changed when the start button (7) is pressed again by the user.

2. The dishwasher (1) as in claim 1, wherein the control card (6) is configured to provide options in the setting menu (S) to be reached when the start button (7) is pressed once and held for at least a first time period (T1) when the door (2) is open.

3. The dishwasher (1) as in claim 2, wherein the control card (6) is configured to store a reference program option having a washing test regardless of the setting menu (S) and providing the reference program option is directly reached when the start button (7) is pressed once and held for at least a first time period (T1) while the door (2) is open, and the reference program is saved when the start button (7) is pressed again and the reference program is executed in the washing process instead of the automatic washing program (P).

4. The dishwasher (1) as in claim 3, wherein the control card (6) is configured to store an option for changing a display (8) language (L) present in the setting menu (S), providing the option of changing the display (8) language (L) when the start button (7) is pressed once and held for at least another time period (T3) while the door (2) is open, and various languages are seen successively on the display (8) and a desired language is saved by pressing the start button (7).

5. The dishwasher (1) as in claim 4, wherein the control card (6) is configured to store both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

6. The dishwasher (1) as in claim 3, wherein the control card (6) is configured to store both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

7. The dishwasher (1) as in claim 2, wherein the control card (6) is configured to store an option for changing a display (8) language (L) present in the setting menu (S), providing the option of changing the display (8) language (L) when the start button (7) is pressed once and held for at least another time period (T3) while the door (2) is open, and various languages are seen successively on the display (8) and a desired language is saved by pressing the start button (7).

8. The dishwasher (1) as in claim 7, wherein the control card (6) is configured to store both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

9. The dishwasher (1) as in claim 2, wherein the control card (6) is configured to store includes both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

10. The dishwasher (1) as in claim 1, wherein the control card (6) is configured to store a reference program option having a washing test regardless of the setting menu (S) and providing the reference program option is directly reached when the start button (7) is pressed once and held for at least a first time period (T1) while the door (2) is open, and the reference program is saved when the start button (7) is pressed again and the reference program is executed in the washing process instead of the automatic washing program (P).

11. The dishwasher (1) as in claim 10, wherein the control card (6) is configured to store an option for changing a display (8) language (L) present in the setting menu (S), providing the option of changing the display (8) language (L) when the start button (7) is pressed once and held for at least another time period (T3) while the door (2) is open, and various languages are seen successively on the display (8) and a desired language is saved by pressing the start button (7).

12. The dishwasher (1) as in claim 11, wherein the control card (6) is configured to store both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

13. The dishwasher (1) as in claim 10, wherein the control card (6) is configured to store both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

14. The dishwasher (1) as in claim 1, wherein the control card (6) is configured to store an option for changing a display (8) language (L) present in the setting menu (S), providing the option of changing the display (8) language (L) when the start button (7) is pressed once and held for at least another time period (T3) while the door (2) is open, and various languages seen successively on the display (8) and a desired language is saved by pressing the start button (7).

15. The dishwasher (1) as in claim 14, wherein the control card (6) is configured to store both the option for changing display (8) language (L) and an option for changing a reference program in the setting menu (S) providing the display (8) language (L) changing option when the start button (7) is pressed once and held for at least the another time period (T3) while the door (2) is open, and thereafter, saving the desired language and leaving the display (8) language (L) changing option when the start button (7) is pressed again, while simultaneously entering the reference program changing option.

16. The dishwasher (1) as in claim 1, wherein the control card (6) is configured to store both a display (8) language (L) changing option and a reference program changing option in the setting menu (S) providing the display (8) language (L) changing option when the start button (7) is pressed once and held for at least another time period (T3) while the door (2) is open, and thereafter, leaving the display (8) language (L) changing option when the start button (7) is pressed again, while simultaneously entering the reference program changing option.

* * * * *